US005143581A

United States Patent [19]

Devic

[11] Patent Number: 5,143,581

[45] Date of Patent: Sep. 1, 1992

[54] METHOD OF PEROXIDE BLEACHING OF PULP PRETREATED WITH A SEQUESTERING AGENT THEN WITH A SULPHITE AND REDUCING AGENT

[75] Inventor: Michel Devic, Sainte-Foy-Les-Lyon, France

[73] Assignee: Atochem, Puteaux, France

[21] Appl. No.: 665,531

[22] Filed: Mar. 6, 1991

[30] Foreign Application Priority Data

Mar. 7, 1990 [FR] France ..... 90 03128

[51] Int. Cl.[5] ..... D21C 9/10; D21C 9/16

[52] U.S. Cl. ..... 162/72; 162/76; 162/78; 162/83; 162/84

[58] Field of Search ..... 162/84, 83, 78, 76, 162/19, 26, 80, 70, 71, 24, 72, 86

[56] References Cited

FOREIGN PATENT DOCUMENTS 0285530 10/1988 European Pat. Off. ..... 162/78

311356 4/1989 European Pat. Off. .

2-50236 12/1989 Japan ..... 162/84

*Primary Examiner*—Steve Alvo

[57] ABSTRACT

A process for the manufacture of high-yield pulps bleached with the aid of hydrogen peroxide in alkaline medium, which consists in subjecting the pulp to be bleached successively to:

(a) a pretreatment with the aid of a sequestering agent for metal ions, followed by a washing operation, (b) a treatment with sulphite and a reducing agent which is more electronegative than the sulphite ion, which act together and in a medium of initial pH between 7 and 12.5, followed by a washing operation to remove the sulphite ions and the reducing agent, and (c) to a bleaching treatment with the aid of hydrogen peroxide in alkaline medium in the presence of a quantity of silicate of between 0% and 1%.

10 Claims, No Drawings

METHOD OF PEROXIDE BLEACHING OF PULP PRETREATED WITH A SEQUESTERING AGENT THEN WITH A SULPHITE AND REDUCING AGENT

BACKGROUND OF THE INVENTION

The present invention relates to a process for the manufacture of bleached high-yield pulps.

High-yield pulps are manufactured by subjecting the starting lignocellulosic matter, such as wood in the form of chips, to an action of mechanical type, combined or otherwise with actions of chemical and thermal type.

High-yield pulps are of very high interest to industry, because they produce an acceptable compromise between solely mechanical pulps and chemical pulps.

"High-yield" means a yield weight of pulp in the dry state relative to the weight of the initial matter in the dry state, which is generally equal to at least 85% and frequently even to 90%.

Bleaching of high-yield pulps, which is made necessary by the quality which is required for paper and similar products in this field, is carried out with the aid of hydrogen peroxide in alkaline medium. Such bleaching also presents a problem both from the technical standpoint and the economic standpoint.

In fact, in order to reduce the loss of effectiveness of hydrogen peroxide, due to its instability in alkaline medium, sodium silicate is used in a quantity such that it is the cause of multiple and considerable difficulties during the production of pulp and that of paper, such as, for example, the formation of solid deposits on production of a paper with a rough feel. Reference can be made on this subject, for example, to C. W. Kutney, Pulp & Paper Canada, 86:12, (1985), 182–189.

Furthermore, the quantity of sodium silicate cannot be reduced without consequently affecting the result of bleaching, making the pulp unacceptable.

To ensure that this result remains sufficiently high, the matter to be bleached may also be subjected, for example, to two stages of bleaching with $H_2O_2$ instead of one, or attempts are made to substitute the silicate with an agent of similar effectiveness, such as diethylenetriaminepentamethylenephosphonic acid (DTMPA), whose equivalence to sodium silicate is apparently verified only in special cases, according to Robert W. Allison, Appita, vol. 36, no. 5, March, 1983, 362–370. Such solutions are not satisfactory in all cases from the economic standpoint.

SUMMARY OF THE INVENTION

The process of the present invention makes it possible to use only one stage of bleaching with the aid of hydrogen peroxide in alkaline medium, to do away with the disadvantages due to sodium silicate, and not to burden the economy of the operation, while providing the bleached pulp with whiteness and mechanical qualities of a high order.

The present invention relates to a process for the manufacture of high-yield pulps bleached with the aid of hydrogen peroxide in alkaline medium, which comprises subjecting the pulp to be bleached successively to:

(a) a pretreatment with the aid of a sequestering agent for metal ions, followed by a washing operation, (b) treatment with sulphite and a reducing agent which is more electronegative than the sulphite ion, which act together and in a medium of initial pH of between 7 and 12.5, followed by a washing operation to remove the sulphite ions and the reducing agent, and (c) a bleaching treatment with the aid of hydrogen peroxide in alkaline medium in the presence of a quantity of silicate of between 0% and 1%.

DETAILED DESCRIPTION

In the definition of the process of the invention which is given above, as in all that follows, the quantity of a compound is expressed in % by weight relative to the weight of pulp in the dry state, unless stated or shown otherwise.

Moreover, in the definition of the process of the invention which is given above, as in all that follows, the following is meant:

(i) "pulps" means pulps as defined above and also lignocellulosic matter in the form of wood chips. A machine of mechanical impregnator type, such as that described, for example, in French Patent No. 2,319,737, the French certificate of addition to this patent, No. 2,436,844, French Patents No. 2,418,295 and 2,451,963, or like that of Impressafiner® type, described, for example, in the work Pulp & Paper Manufacture, 3rd Edition, vol. 2, Mechanical pulping, pages 98, 99, can be employed for carrying out all or part of the process of the invention starting with any pulp, as meant here. Otherwise the process of the invention can be carried out in any equipment combining units of apparatus which are known in the papermaking industry to be suitable for pretreatment, such as, among others, mixers, filters, presses and bleaching towers:

(ii) "pretreatment of the pulp by means of a sequestering agent for metal ions" means the operation which consists of subjecting the said pulp to the action of a compound such as, for example, sodium tripolyphosphate, sodium tetrapyrophosphate and the sodium salts of acetic, nitrilotriacetic, ethylenediaminetetraacetic and diethylenetriaminepentaacetic (DTPA) acids.

The sequestering agent is used in a proportion of approximately 0.1% to 1%.

The pretreatment with sequestering agent is in most cases carried out at a temperature of between approximately 20° C. and 100° C., preferably between 50° C. and 95° C. so as not to have to work under pressure. The consistency and the content of lignocellulosic matter in the dry state in the pulp, can in this case be chosen between fairly wide limits, for example between approximately 5% and 50%;

(iii) "washing" means the operation which make it possible to remove more or less completely from the pulp the liquid phase which is present in it, by, for example, concentrating the pulp by pressing on a filter, or by virtue of a sequence, reiterated or otherwise, of diluting the pulp, for example, by pressing on a filter; the efficiency of the washing is reflected in the degree of the removal of the liquid phase which was present before washing, expressed in %.

The washing which follows the pretreatment with a sequestering agent, like washing, to remove the sulphite ions and the reducing agent, is in most cases carried out by virtue of the dilution-concentration sequence, at a temperature which is generally between approximately 20° C. and 90° C., often between 20° C. and 60° C. for economic reasons. The efficiency of such washing operations is preferably higher than 90%;

(iv) "sulphite" means sodium sulphite, $Na_2SO_3$, or sodium bisulphite, $NaHSO_3$, or more generally a mixture of sulphur dioxide $SO_2$ and sodium hydroxide; the quantity of sulphite which is introduced is that usually employed in processes which do not incorporate the invention but which are known to be suitable for the production of chemithermomechanical pulp (CTM pulps). This quantity, expressed as $SO_2$, is consequently in most cases between approximately 0.5% and 6%;

(v) "reducing agent which is more electronegative than the sulphite ion $SO_3H$" means a compound referred to in all that follows as a reducing agent and chosen in most cases from thiourea dioxide or formamidinesulphinic acid, sodium borohydride, sodium hydrosulphite or sodium dithionite.

The quantity of reducing agent which is used may vary according to the nature of the latter. It is generally between 0.1 and 5% in the case of thiourea dioxide or of dithionite. Sodium borohydride is employed in a proportion of approximately 0.01% to 0.5%. This reducing agent is conveniently employed in the form of an aqueous solution such as, for example, the solution containing 12% by weight of sodium borohydride and marketed under the name of Borol ® by Ventron Corporation.

The combined action of sulphite and of the reducing agent on the pulp, the sulphite and the reducing agent being present together in contact with pulp, takes place at a temperature of between approximately 20° C. and 200° C. It is preferably chosen between 60° C. and 140° C. When the temperature is equal to or higher than 100° C. the combined action of sulphite and of the reducing agent takes place under saturated steam pressure.

A sequestering agent, of a nature and in a quantity as in the pretreatment, may be sometimes advantageously present with the sulphite and the reducing agent.

The consistency during the combined action of sulphite and of the reducing agent is normally between approximately 5% and 50% depending on the method of carrying out the operation, and generally between 10% and 30%. The length of the operation depends on other operational parameters, including the type of equipment employed. Normally it does not exceed 1 hour and is generally between a few tens of seconds and 30 minutes. A very short time corresponds to carrying out the operation in a wood chip processing machine to which reference was made above;

(vi) "treatment of bleaching with the aid of hydrogen peroxide in alkaline medium" means the operation carried out by introducing a quantity of hydrogen peroxide of between approximately 0.5% and 10%, preferably between 2% and 6%, in the presence of approximately 0% to 1% and preferably less than 1% of silicate, at pH of between approximately 9 and 11, at a temperature of between 40° C. and 100° C. for approximately 0.5 hour to 6 hours, with a consistency of between 10% and 30%. The bleaching solution may contain additives such as essentially one or more sequestering agents such as, for example, diethylenetriaminepentaacetic and ethylenediaminetetraacetic acids in the form of sodium salts in a quantity which is generally between approximately 0.1% and 1%.

The quantity of sodium hydroxide which is present with the hydrogen peroxide in the bleaching treatment is generally between 1% and 6%, and in most cases between 2% and 3%. The optimum quantity depends essentially on the nature of the wood; and (vii) "silicate" means an aqueous solution of sodium silicate with a relative density of 1.33.

The following examples, which are given by way of guidance but without any limitation being implied, illustrate the invention. Examples are also given by way of comparison of the process of the invention with known processes.

In all the examples:

(i) the high-yield pulp bleached with the aid of hydrogen peroxide was obtained by subjecting the same single mechanical mill pulp to the process of the invention or to a known process. This starting pulp contains a mixture of softwood and hardwood in the proportion of 75/25 and its whiteness, measured by refractometry at 457 nm according to the ISO standard, is 60.6° ISO.

(ii) the quantities of matter are expressed, as above, in % by weight relative to the weight of pulp in the dry state, unless stated or shown otherwise, (iii) DTPA is employed in the form of sodium salt in aqueous solution at a concentration of 40% by weight, and the quantity shown is that of this solution, (iv) sodium borohydride is applied in the form of Borol ®, and the quantity shown is that of this form, (v) sodium silicate is introduced, as already stated, in the form of an aqueous solution of sodium silicate of relative density 1.33, and the quantity shown is that of this solution, (vi) magnesium is used in the form of magnesium sulphate, and its quantity is expressed as Mg, (vii) hydrogen peroxide is counted as 100%, as previously, (viii) the efficiency of the washing operations after the pretreatment with a sequestering agent and after the action of sulphite with the reducing agent is higher than 90%, (ix) the quantity of sodium hydroxide present in the bleaching treatment with $H_2O_2$ is alkaline medium is that which, with other parameters being taken into account, results in the highest whiteness, and (x) whiteness is measured on the bleached pulp adjusted to pH 6 with the aid of $SO_2$, by refractometry at 457 nm according to ISO Standard, and is expressed in degress ISO (° ISO).

EXAMPLE 1

The original pulp was first of all subjected to a treatment with the aid of 0.5% of DPTA for 15 minutes at 90° C. at a consistency of 10% and then washed and then subjected to the combined action of 5% of $Na_2SO_3$ and of 1% of Borol ® for 0.5 hour at 90° C. at a consistency of 20%.

The pulp which thus resulted from the succession of the operations of pretreatment with the aid of the sequestering agent for metal ions, of washing and of treatment with sulphite together with the reducing agent, was washed and finally subjected to a bleaching treatment with the aid of hydrogen peroxide in alkaline medium for 5 hours at 60° C. at a consistency of 20% with 4% of $H_2O_2$, 4% of NaOH, 0.5% of DTPA and in the absence of silicate.

The bleached pulp thus obtained has a whiteness of 83.9° ISO.

EXAMPLE 2

Example 1 was repeated, except that the bleaching treatment with the aid of hydrogen peroxide in alkaline medium was carried out in the presence of 1% of silicate.

The bleached pulp obtained had a whiteness of 84.7%.

EXAMPLES 3 AND 4

(Comparative)

Example 1 was repeated, except that the bleaching treatment with the aid of hydrogen peroxide in alkaline medium was carried out in the presence of 2% of silicate in Example 3 and 4% of silicate in Example 4.

It was found that the bleached pulp resulting from these two tests had a whiteness of 84.9% and therefore practically the same as that reached in Example 2.

EXAMPLES 5,6, 7 AND 8

(Comparative)

Example 1 was repeated, with the treatment of the pulp with sulphite together with the reducing agent being dispensed with and with only the pretreatment with the sequestering agent, the washing after the said pretreatment, and the bleaching treatment with hydrogen peroxide in alkaline medium being retained.

In the latter case, the silicate was absent in Example 5 and was present in a proportion of 1% in Example 6, 2% in Example 7 and 4% in Example 8.

The pulp had a whiteness of 76% in the case of Example 5, 78.2% in the case of Example 6, 80.3% in the case of Example 7 and 82.5% in the case of Example 8.

EXAMPLE 9

(Comparative)

After the pretreatment with the sequestering agent and the washing which follows it, which were carried out as in Example 1, the washed pulp was subjected to a first bleaching treatment with $H_2O_2$ in alkaline medium in the absence of silicate, at 60° C. and at a consistency of 20% as in Example 1, but for 1.5 hours with 1.44% of $H_2O_2$ and 1.3% of NaOH and then to a washing operation and finally to a second bleaching treatment with $H_2O_2$ in alkaline medium under the same temperature and consistency conditions as the first, but with 2.56% of $H_2O_2$, 3.1% of NaOH and 0.05% of Mg.

The bleached pulp obtained had a whiteness of 82.5%° ISO.

The above examples emphasize the advantage of the process of the invention when compared with a single bleaching treatment with hydrogen peroxide in alkaline medium, even when carried out with a quantity of silicate corresponding to the optimum silicate content (4%) and when compared with two successive bleaching treatments with hydrogen peroxide in alkaline medium without silicate.

While the invention has been described in connection with a preferred embodiment, it is not intended to limit the scope of the invention to the particular form set forth, but on the contrary, it is intended to cover such alternatives, modifications, and equivalents as may be included with the scope and spirit of the invention as defined by the appended claims.

What is claimed is:

1. A process for the manufacture of high-yield pulps bleached with the aid of hydrogen peroxide in an alkaline medium, comprising subjecting with pulp to be bleached successively to:

(a) a pretreatment with the aid of a sequestering agent for metal ions, followed by a washing operation, (b) a treatment with sulphite and a reducing agent which is more electronegative than the sulphite ion, which act together and in a medium of initial pH between about 7 and 12.5, followed by a washing operation to remove the sulphite ions and the reducing agent, and (c) to a bleaching treatment with the aid of hydrogen peroxide in alkaline medium in the presence of a quantity of silicate of between about 0% to 1%.

2. The process of claim 1, in which the sequestering agent is sodium tripolyphosphate, sodium tetrapyrophosphate, or the sodium salts of acetic, nitrilotriacetic, ethylenediaminetetraacetic or diethylenetriaminepentaacetic acids.

3. The process of claim 2, in which the pretreatment is carried out at a temperature of between about 20° C. and 100° C., at a consistency of between about 5% and 50%, with the aid of a quantity of sequestering agent of between about 0.1% and 1%.

4. The process of claim 3, in which the sulphite and the reducing agent which is more electronegative than the sulphite ion act together at a temperature of between about 20° C. and 200° C.

5. The process of claim 4, in which the temperature at which the sulphite and the reducing agent act together is between about 60° C. and 140° C.

6. The process of claim 5, in which the quantity of sulphite, expressed as sulphur dioxide $SO_2$, is between about 0.5% and 6%.

7. The process claim 6, in which the reducing agent which is more electronegative than the sulphite ion is thiourea dioxide, sodium hydrosulphite, or sodium borohydride.

8. The process of claim 7, in which the quantity of thiourea dioxide or of the hydrosulphite present with the sulphite is between about 0.1% and 5.0%.

9. The process of claim 7, in which the quantity of sodium borohydride present in the sulphite is between about 0.01% and 0.5%.

10. The process of any one of claims 1 to 9, in which the bleaching with the aid of hydrogen peroxide in alkaline medium is carried out with a quantity of the said peroxide of between about 0.5% to 10%, at a pH of between about 9 to 11, at a temperature of between about 40° C. to 100° C., and at a consistency of between about 10% to 30%.

* * * * *